US007896527B2

(12) United States Patent
Chen

(10) Patent No.: US 7,896,527 B2
(45) Date of Patent: Mar. 1, 2011

(54) LIGHT-EMITTING DIODE ILLUMINATING EQUIPMENT WITH REPLACEABLE SHELL

(75) Inventor: Jen-Shyan Chen, Hsinchu (TW)

(73) Assignee: Neobulb Technologies, Inc. (BN)

( * ) Notice: Subject to any disclaimer, the term of this patent is extended or adjusted under 35 U.S.C. 154(b) by 287 days.

(21) Appl. No.: 12/068,630

(22) Filed: Feb. 8, 2008

(65) Prior Publication Data

US 2008/0192494 A1 Aug. 14, 2008

(30) Foreign Application Priority Data

Feb. 9, 2007 (TW) ..... 96104726 A

(51) Int. Cl.
*F21V 29/00* (2006.01)

(52) U.S. Cl. ..... 362/294; 362/124; 362/240; 362/249.02; 362/373; 362/808

(58) Field of Classification Search ..... 362/121, 362/124, 218, 249.02, 294, 373, 545, 547, 362/800, 806–809; 313/12, 46
See application file for complete search history.

(56) References Cited

U.S. PATENT DOCUMENTS 4,729,076 A * 3/1988 Masami et al. ..... 362/294

FOREIGN PATENT DOCUMENTS

WO WO-2007/143875 A2 * 12/2007

* cited by examiner

*Primary Examiner*—Stephen F Husar
(74) *Attorney, Agent, or Firm*—Thomas, Kayden, Horstemeyer & Risley, LLP.

(57) ABSTRACT

The invention discloses a light-emitting diode illuminating equipment including an illuminating apparatus and a replaceable shell. The replaceable shell is detachable to be engaged to the illuminating apparatus. The illuminating apparatus includes a heat-dissipating plate device, a plurality of diode light-emitting devices, a plurality of heat-conducting devices, and a hollow barrel. The hollow barrel is engaged to the heat-dissipating plate device to form a space for accommodating the diode light-emitting devices and the heat-conducting devices. Depending on different product designs, the replaceable shell is variously detachable to be engaged to the heat-dissipating plate device or the hollow barrel. Therefore, the appearance of the light-emitting diode illuminating equipment of the invention is beautified by the appearance design of the replaceable shell.

21 Claims, 10 Drawing Sheets

LIGHT-EMITTING DIODE ILLUMINATING EQUIPMENT WITH REPLACEABLE SHELL

BACKGROUND OF THE INVENTION

1. Field of the Invention

This present invention relates to a light-emitting diode illuminating equipment, and more particularly relates to a light-emitting diode illuminating equipment with a replaceable shell.

2. Description of the Prior Art

A light-emitting diode (LED) has advantages of power saving, vibration resistance, fast response, production ability, and so on, so the illuminating equipment with light sources of LEDs is currently being studied and developed. Such as a conventional illuminating equipment, the shield thereof are usually function-oriented and with smaller consideration of appearance beautification. If the appearance design of the illuminating equipment is also considered, the difficulties in manufacturing and shield design will rise. Furthermore, if the request for replacing difference appearance shields is considered, the total cost of the illuminating equipment will increase much and the replacement is time-consuming and inconvenient.

Accordingly, there is a need to provide a light-emitting diode illuminating equipment with a replaceable shell to solve the problems mentioned above.

SUMMARY OF THE INVENTION

A scope of the invention is to provide a light-emitting diode illuminating equipment with a replaceable shell.

The light-emitting diode illuminating equipment of the invention includes an illuminating apparatus and a replaceable shell. The illuminating apparatus includes a heat-dissipating plate device, M heat-conducting devices, N diode light-emitting devices, a hollow barrel, and a transparent shield, wherein M and N are natural numbers, and N is larger or equal to M. The heat-dissipating plate device includes a first surface and a second surface opposite to the first surface. A plurality of heat-dissipating fins extend from the second surface. Each of the heat-conducting devices includes a first portion and a second portion. The second portion extends from the first portion and includes a flat end. Each of the diode light-emitting devices is disposed on the flat end of one of the heat-conducting devices and converts an electric energy into a light. It is noticed that because N is larger or equal to M, there is at least one of the diode light-emitting devices disposed on the flat end of each of the heat-conducting devices. The hollow barrel includes a circumference, which the hollow barrel is engaged through to the heat-dissipating plate device to expose the heat-dissipating fins to the air and to form a space for accommodating the heat-conducting devices and the diode light-emitting devices. The transparent shield is engaged to the hollow barrel to cover the diode light-emitting devices.

The replaceable shell is detachable to be engaged to the illuminating apparatus. In an embodiment, the replaceable shell is engaged to the heat-dissipating plate device of the illuminating apparatus. In another embodiment, the replaceable shell is engaged to the hollow barrel of the illuminating apparatus. In the latter embodiment, the hollow barrel includes a first fixing column and a second fixing column. The replaceable shell is detachable to be engaged to the first fixing column. The illuminating apparatus is detachable to be engaged through the second fixing column to a support. In another embodiment, the replaceable shell includes a clamping portion, and the hollow barrel includes a fixed portion accordingly. The clamping portion is detachable to be engaged to the fixed portion. In another embodiment, the hollow barrel is made of magnetic material, and the replaceable shell includes a magnet. The replaceable shell is magnetized through the magnet on the hollow barrel.

The light-emitting diode illuminating equipment of the invention further includes a partition plate device. The partition plate device is disposed in the hollow barrel to divide the space into a first room and a second room. The partition plate device thereon includes P first holes. P is a natural number, and P is smaller or equal to N. Each of the diode light-emitting devices corresponds to one of the first holes. It is noticed that because P is smaller or equal to N, each of the first holes corresponds to at least one of the diode light-emitting devices. Furthermore, the light-emitting diode illuminating equipment further includes a heat-insulating plate device disposed in the first room. The heat-insulating plate device thereon includes M second holes. The second portion of each of the heat-conducting devices corresponds to one of the second holes and passes through the corresponding second hole.

Therefore, although the light-emitting diode illuminating equipment of the invention includes the replaceable shell, the structure with good heat-dissipating efficiency is still kept. Besides, the replaceable shell could be attached only to the hollow barrel, the heat-dissipating fins, or other place to engage. The replaceable shell could be easily and fast detached or attached without influencing the original heat-dissipating structure. Therefore, the replaceable shell of the light-emitting diode illuminating equipment could be replaced with different shells to beautify the light-emitting diode illuminating equipment, which is both practical and beautiful.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
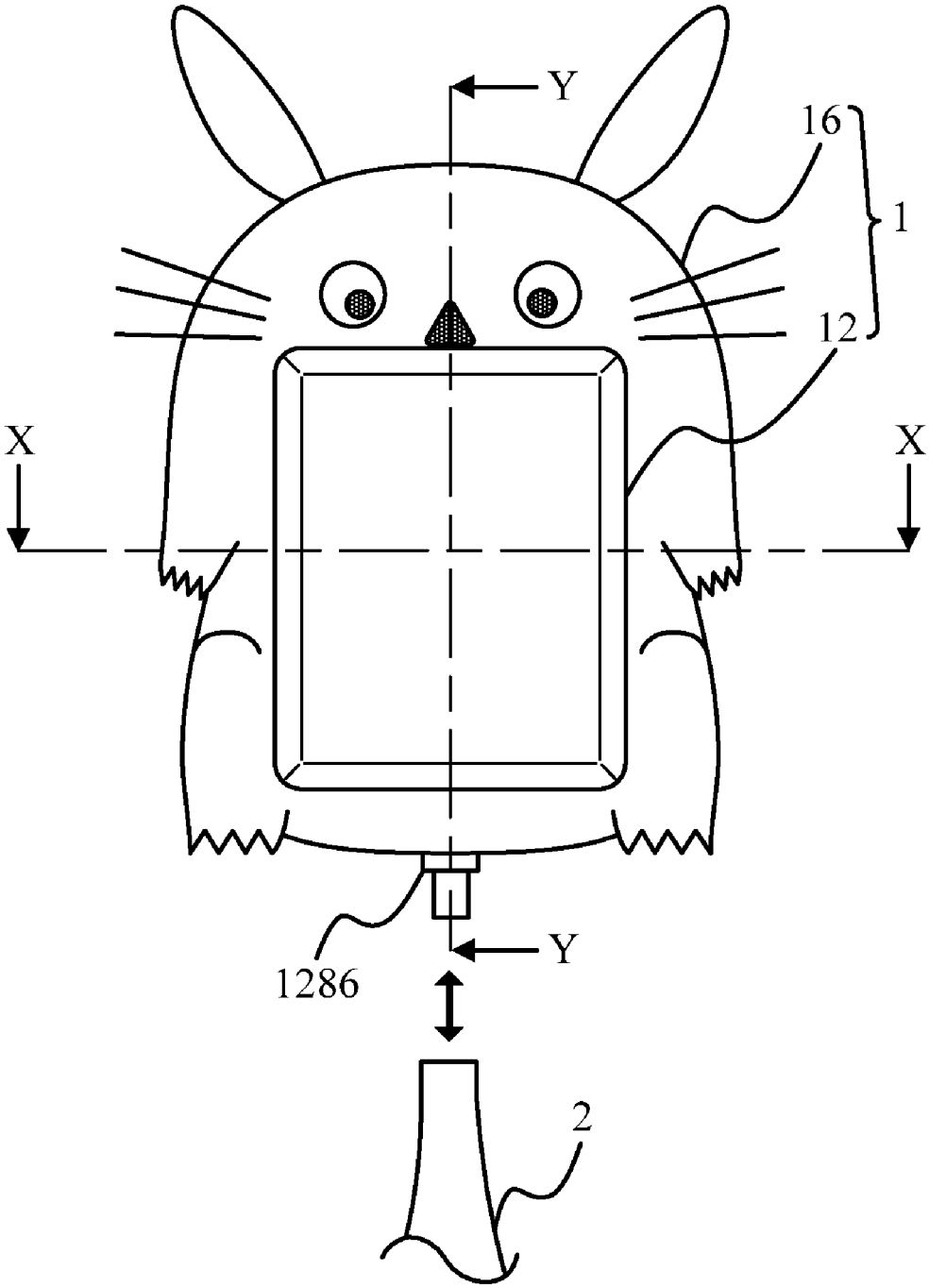
FIG. 1 is a front view of a light-emitting diode illuminating equipment according to a first preferred embodiment.

Please refer to FIG. 1. FIG. 1 is front view of a light-emitting diode illuminating equipment 1 according to a first preferred embodiment. The light-emitting diode illuminating equipment 1 of the invention includes an illuminating apparatus 12 and a replaceable shell 16. The light-emitting diode illuminating equipment 1 could be mounted on a support 2. The replaceable shell 16 is a style shell for beautifying the appearance of the light-emitting diode illuminating equipment 1. The replaceable shell 16 is detachable to be engaged to the illuminating apparatus 12.

Figure 2A:
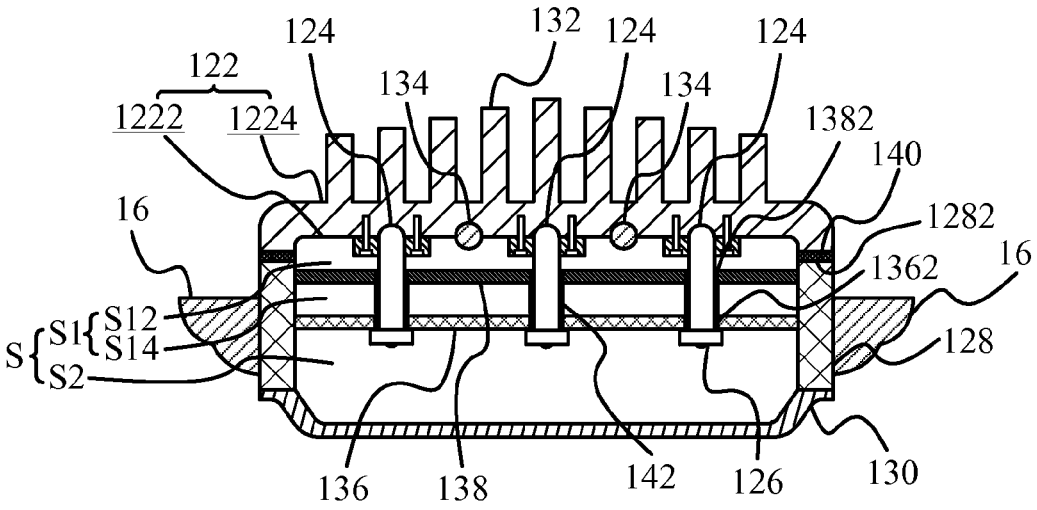
FIG. 2A is a cross section of the light-emitting diode illuminating equipment along the line X-X in FIG. 1.
Figure 2B:
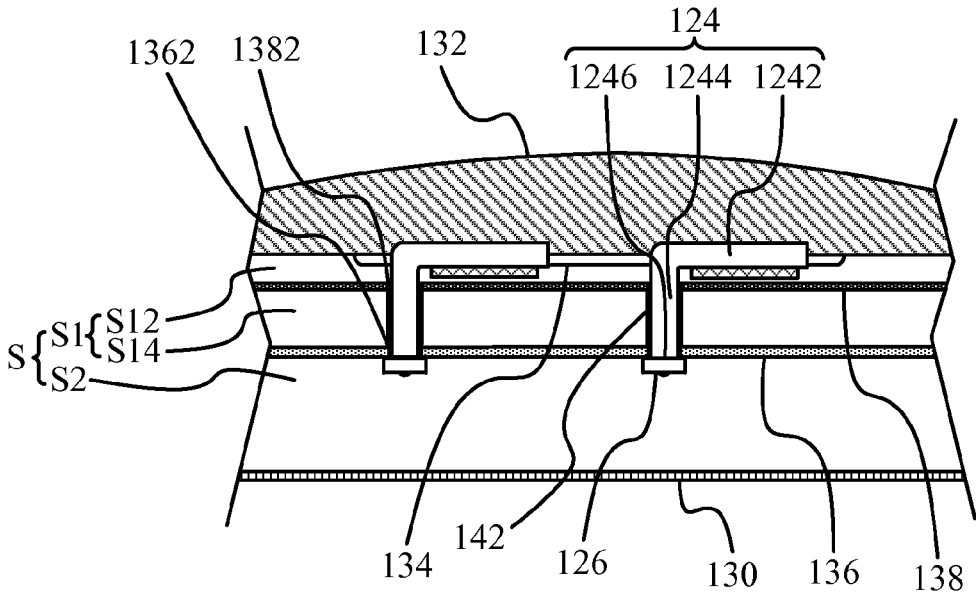
FIG. 2B is a cross section of the light-emitting diode illuminating equipment along the line Y-Y in FIG. 1.

Please refer to FIGS. 2A and 2B. FIG. 2A is a cross section of the light-emitting diode illuminating equipment 1 along the line X-X in FIG. 1. FIG. 2B is a cross section of the light-emitting diode illuminating equipment 1 along the line Y-Y in FIG. 1. According to the first preferred embodiment, the light-emitting diode illuminating equipment 1 includes a heat-dissipating plate device 122, six first heat-conducting devices 124, six diode light-emitting devices 126, a hollow barrel 128, and a transparent shield 130. The heat-dissipating plate device 122 includes a first surface 1222 and a second surface 1224 opposite to the first surface 1222. Each of the first heat-conducting devices 124 includes a first portion 1242 and a second portion 1244 extending from the first portion 1242 and including a flat end 1246. Each of the diode light-emitting devices 126 is disposed on the flat end 1246 of one of the first heat-conducting devices 124 and converts an electric energy into a light. The hollow barrel 128 includes a circumference 1282, which the hollow barrel 128 is engaged through to the heat-dissipating plate device 122 to form a space S for accommodating the first heat-conducting devices 124 and the diode light-emitting devices 126. The transparent shield 130 is engaged to the hollow barrel 128 and covers the diode light-emitting devices 126. Furthermore, the light-emitting diode illuminating equipment 1 further includes a plurality of heat-dissipating fins 132. The heat-dissipating fins 132 extend from the second surface 1224 and are exposed to the air.

It is noticed that although there is only one diode light-emitting device 126 disposed on the flat end 1246 of the second portion 1244 of each of the first heat-conducting devices 124 in the first preferred embodiment, the invention is not limited to this. That is to say, there could be more than one diode light-emitting devices 126 disposed on the flat 1246 of the second portion 1244 of each of the first heat-conducting devices 124. For example, the diameter of the second portion 1244 of the first heat-conducting device 124 is larger enough to allow two or more diode light-emitting devices 126 to be disposed thereon. Alternatively, the flat end 1246 is formed by bending and pressing the second portion 1244 such that there is enough area for accommodating several diode light-emitting devices 126 disposed thereon. Incidentally, the first heat-conducting devices 124 are not limited to be columnar.

According to the first preferred embodiment, the heat-dissipating plate device 122 includes six first grooves (not denoted in the figures) formed on the first surface 1222 of the heat-dissipating plate device 122. The first portion 1242 of each of the first heat-conducting devices 124 corresponds to one of the first grooves and is mounted on the corresponding first groove. A heat-conducting material is filled between the first portion 1242 of each of the first heat-conducting devices 124 and the corresponding first groove for enhancing the heat-conducting efficiency of the first heat-conducting devices 124 to the heat-dissipating plate device 122. Furthermore, the light-emitting diode illuminating equipment 1 includes two second heat-conducting devices 134 mounted on the first surface 1222 of the heat-dissipating plate device 122. Besides, the heat-dissipating plate device 122 also includes two grooves (not denoted in the figures) on the first surface 1222. Each of the second heat-conducting devices 134 corresponds to one of the second grooves and is mounted on the corresponding second groove. The second heat-conducting devices 134 are conducive to distributing the heat transferred through the first heat-conducting devices 124 to the heat-dissipating plate device 122 more uniformly on the heat-dissipating plate device 122 and further to enhancing the heat-dissipating efficiency of the heat-dissipating plate device 122. Similarly, it is conducive to distributing the heat transferred to the heat-dissipating plate device 122 more uniformly to fill with a heat-conducting material between each of the second heat-conducting devices 134 and the corresponding second groove.

Figure 2C:
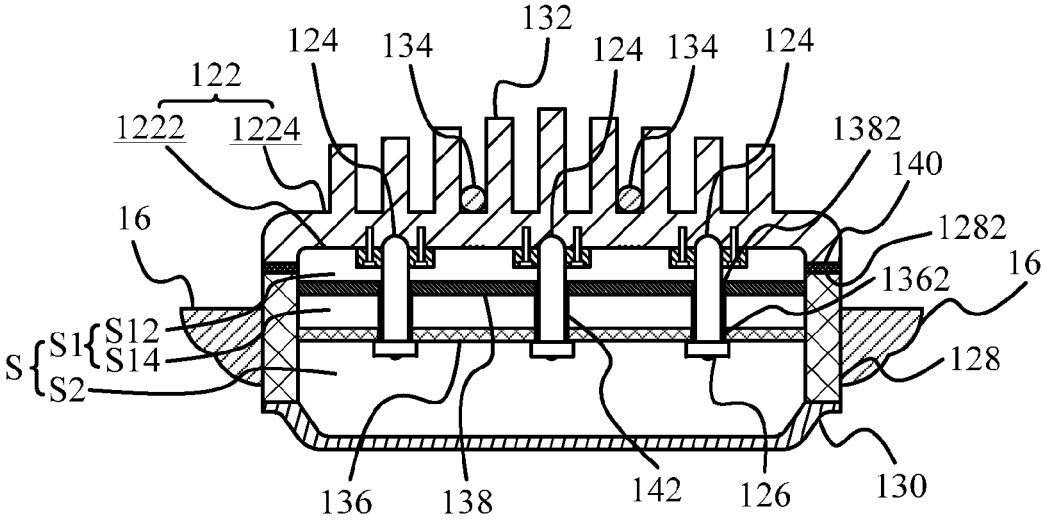
FIG. 2C is a cross section of a light-emitting diode illuminating equipment according to an embodiment along the line X-X in FIG. 1.

Incidentally, the quantity and the disposition of the second heat-conducting devices 134 are not limited to the first preferred embodiment. Furthermore, in another embodiment, the second heat-conducting devices 134 are mounted on the second surface 1224 of the heat-dissipating plate device 122, as shown in FIG. 2C. FIG. 2C is a cross section of the light-emitting diode illuminating equipment according to the embodiment along the line X-X in FIG. 1. In the embodiment, the second heat-conducting devices 134 are disposed between the heat-dissipating fins 132. It is also conducive to distributing the heat transferred to the heat-dissipating plate device 122 uniformly so as to enhance the heat-dissipating efficiency of the heat-dissipating plate device 122. In application, the second heat-conducting devices 134 are not limited to be disposed between the heat-dissipating fins 132. The quantity and the disposition depend on actual product design. For example, the second heat-conducting devices 134 could be disposed on the surface 1224 of the heat-dissipating plate device 122 in a radial pattern.

According to the first preferred embodiment, the illuminating apparatus 12 includes a partition plate device 136 which is disposed in the hollow barrel 128 to divide the space S into a first room S1 and a second room S2. The partition plate device 136 includes six first holes 1362 thereon. Each of the diode light-emitting devices 126 corresponds to one of the first holes 1362. It is noticed that each of the first holes 1362 corresponds to one of the diode light-emitting devices 126 in the first preferred embodiment, but in a practical product design, each of the first holes 1362 is not limited to correspond to only one of the diode light-emitting devices 126 and the shape thereof is not limited to be circular. Furthermore, the diode light-emitting devices 126 are not limited to be disposed in the second room S2; that is, they could be disposed in the first room S1 or the first holes 1362.

According to the first preferred embodiment, the illuminating apparatus 12 includes a heat-insulating plate device 138 which is disposed in the first room S1 to divide the first room S1 into a third room S12 and a fourth room S14. The heat-insulating plate device 138 includes six second holes 1382 thereon. The second portion 1244 of each of the first heat-conducting devices 124 corresponds to one of the second holes 1382 and passes through the corresponding second hole 1382. The heat-insulating plate device 138 is used for preventing or reducing the heat transferred from the heat-dissipating plate device 122 to the fourth room S14, even to the second room S2 to influence the lighting efficiency and the operation life of the diode light-emitting devices 126. For further enhancing the heat-insulating efficiency, the illuminating apparatus 12 includes a plurality of heat-insulating sleeves 142 covering the second portion 1244 of each of the first heat-conducting devices 124. Thereby, when the heat generated in operation by the diode light-emitting devices 126 is transferred through the first heat-conducting devices 124 to the heat-dissipating plate devices 122, the heat is not dissipated into the fourth room S14.

Furthermore, the illuminating apparatus 12 includes a heat-insulating ring 140 which the hollow barrel 128 is engaged through to the heat-dissipating plate device 122. Thereby, the heat on the heat-dissipating plate device 122 is not transferred to the hollow barrel 128. With the heat-insulating design of the heat-insulating plate device 138, the heat on the heat-dissipating plate device 122 could be insulated mostly. Incidentally, if the partition plate device 136 has the property of insulating heat, the partition plate device 136 and the heat-insulating plate device 138 could be designed to be integrated into single component.

Figure 2D:
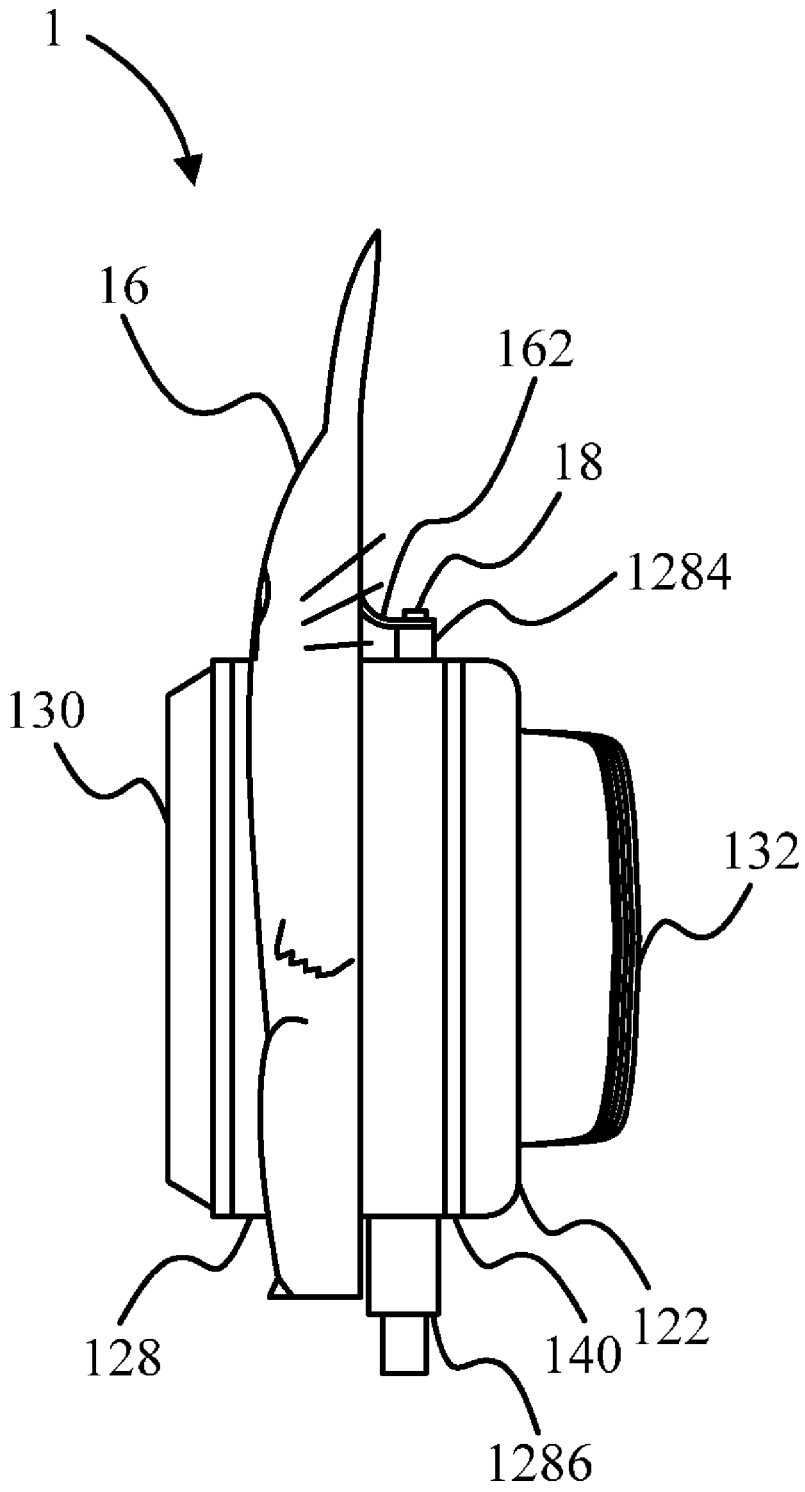
FIG. 2D is a side view of the light-emitting diode illuminating equipment.

Please refer to FIG. 2D. FIG. 2D is a side view of the light-emitting diode illuminating equipment 1. According to the first preferred embodiment, the replaceable shell 16 is detachable to be engaged to the hollow barrel 128. The hollow barrel 128 includes a first fixing column 1284 for the detachable engagement with the replaceable shell 16. The replaceable shell 16 includes a fixing piece 162. The first fixing column 1284 includes a female thread. The replaceable shell 16 could be engaged to the hollow barrel 128 by screwing a screw 18 to fix the fixing piece 162 to the first fixing column 1284. In addition, the hollow barrel 128 includes a second fixing column 1286. The illuminating apparatus 12 could be detachable to the support 2 through the second fixing column 1286 (referring to FIG. 1). Furthermore, the second fixing column 1286 could be a hollow tube for allowing a power cord (not shown in the figures) passing through so that a power could supply power through the power cord to the light-emitting diode illuminating equipment 1. In an embodiment, the second fixing column 1286 includes a male thread, and the support 2 includes a female thread accordingly. By matching the male thread with the female thread, the illuminating apparatus 12 is engaged to the support 2. It is noticed that the location of the first fixing column 1284 is not limited to the location shown in FIG. 2D, and the first fixing column 1284 could be at either side of the hollow barrel 128 (at this case, two first fixing columns for structure balance are suggested).

Figure 2E:
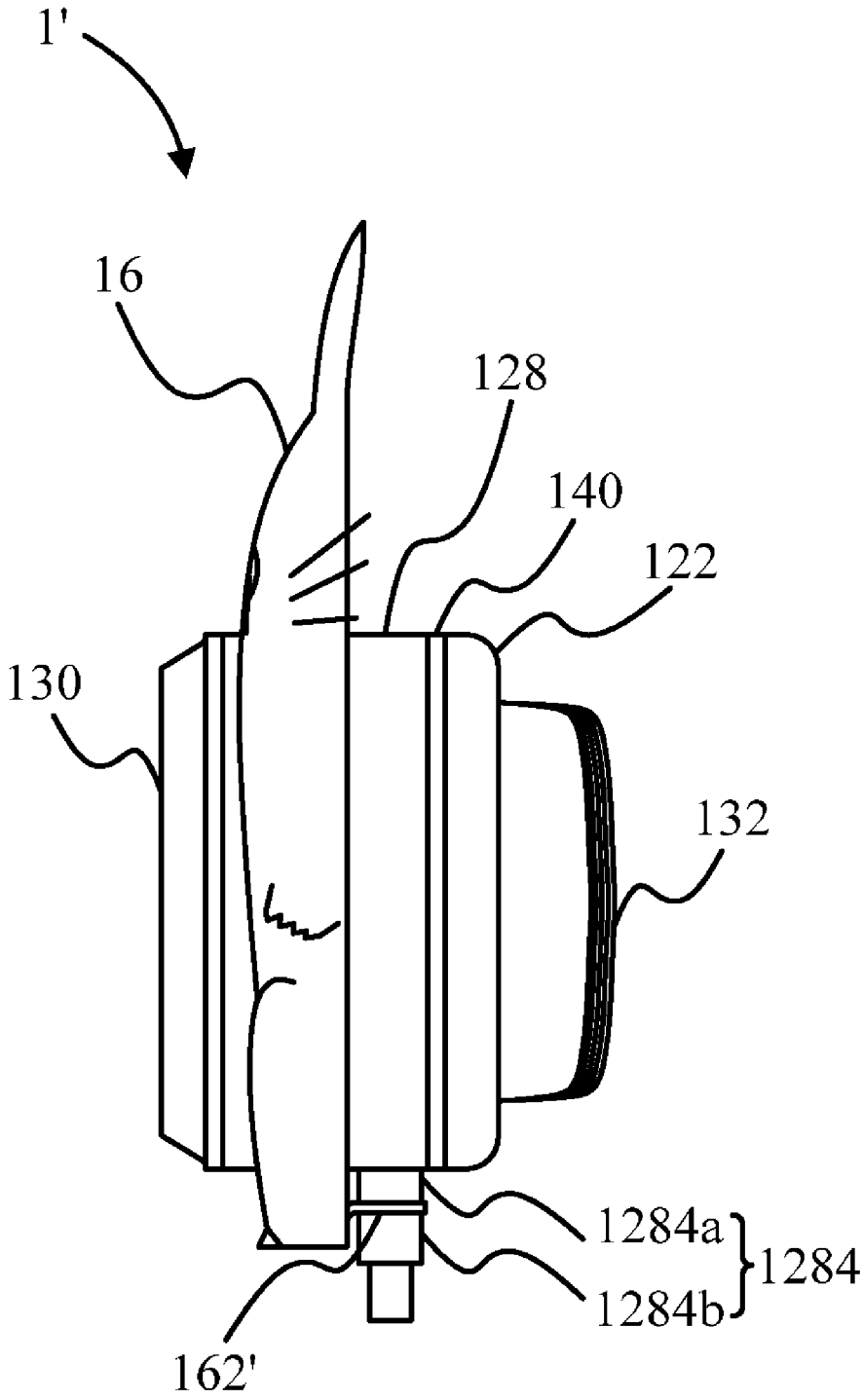
FIG. 2E is a side view of a light-emitting diode illuminating equipment according to an embodiment.

Please refer to FIG. 2E. FIG. 2E is another side view of a light-emitting diode equipment 1' according to an embodiment. In the embodiment, the first fixing column 1284 and the second fixing column 1286 are integrated, and the structure is need to be partially modified. As shown in FIG. 2E, the first fixing column 1284 is of two segments. The first segment 1284*a* is connected to the hollow barrel 128 and forms a male thread thereon. The second segment 1284*b* includes a male thread and a female thread. The male thread of the first segment 1284*a* is engaged to the female thread of the second segment 1284*b*, therein the fixing piece 162 of the replaceable shell 16 is fixed between the first segment 1284*a* and the second segment 1284*b*. Then, the male thread of the second segment 1284*b* is screwed in the support 2 for fixing the illuminating apparatus 12. At this case, the fixing piece 162 of the replaceable shell 162 could include a C-shaped hole (that is a non-closed circle, the shape of which is similar to the denotation 164 in FIG. 3A), which it is convenient for the power cord to cross when replacing the replaceable shell 16.

Figure 3A:
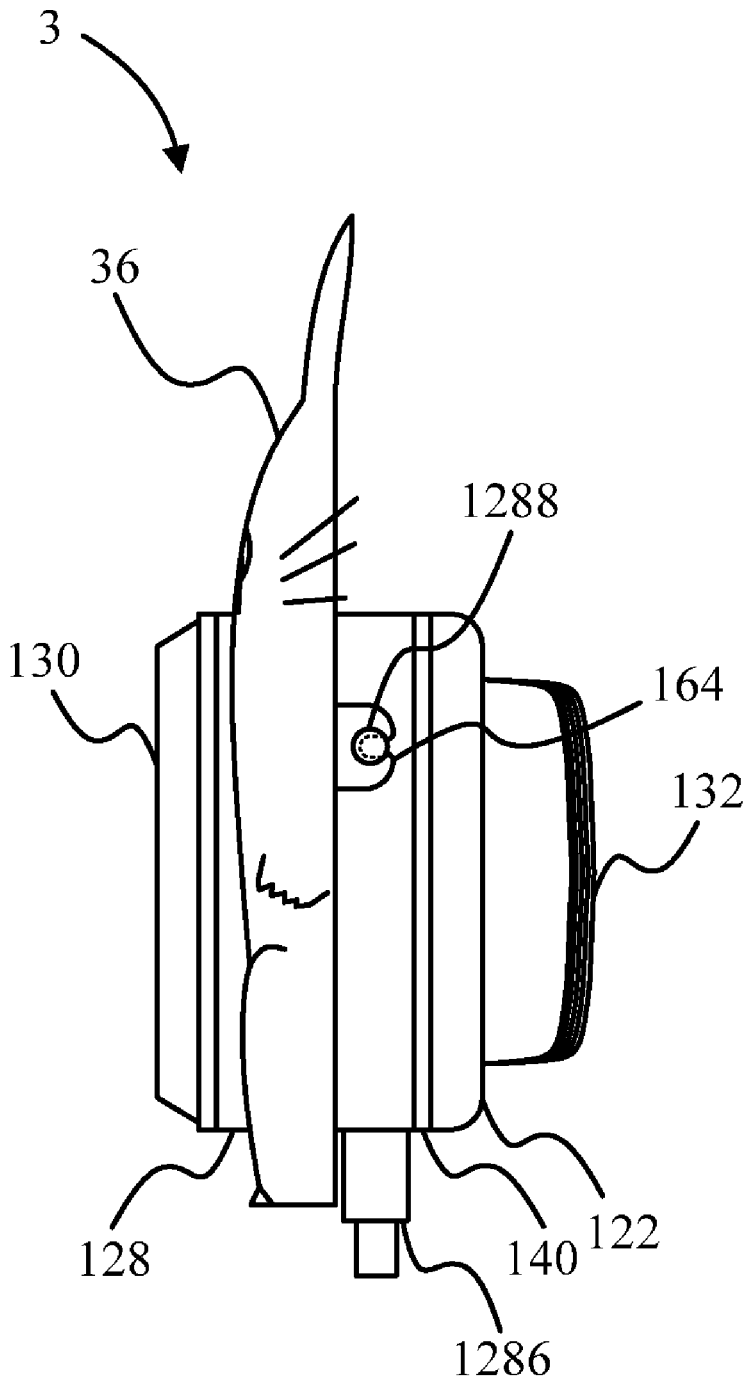
FIG. 3A is a side view of a light-emitting diode illuminating equipment according to a second preferred embodiment.

Please refer to FIG. 3A. FIG. 3A is a side view of a light-emitting diode illuminating equipment 3 according to a second preferred embodiment. Compared with the light-emitting diode illuminating equipment 1 of the first preferred embodiment, the difference is that the hollow barrel 128 of the light-emitting diode illuminating equipment 3 includes a fixing portion 1288 and the replaceable shell 36 of the light-emitting diode illuminating equipment 3 includes a clipping portion 164. The clipping portion 164 is detachable to be engaged to the fixing portion 1288. Thereby, the replaceable shell 36 is engaged to the hollow barrel 128. Therein, the quantity of the fixing portion 1288 is not limited to be one, and the location thereof is not limited to FIG. 3A either. In addition, the fixing portion 1288 could be designed to be integrated with the second fixing column 1286. For example, a groove is formed on the second fixing column 1286 for the clipping portion 164 to clip.

Figure 3B:
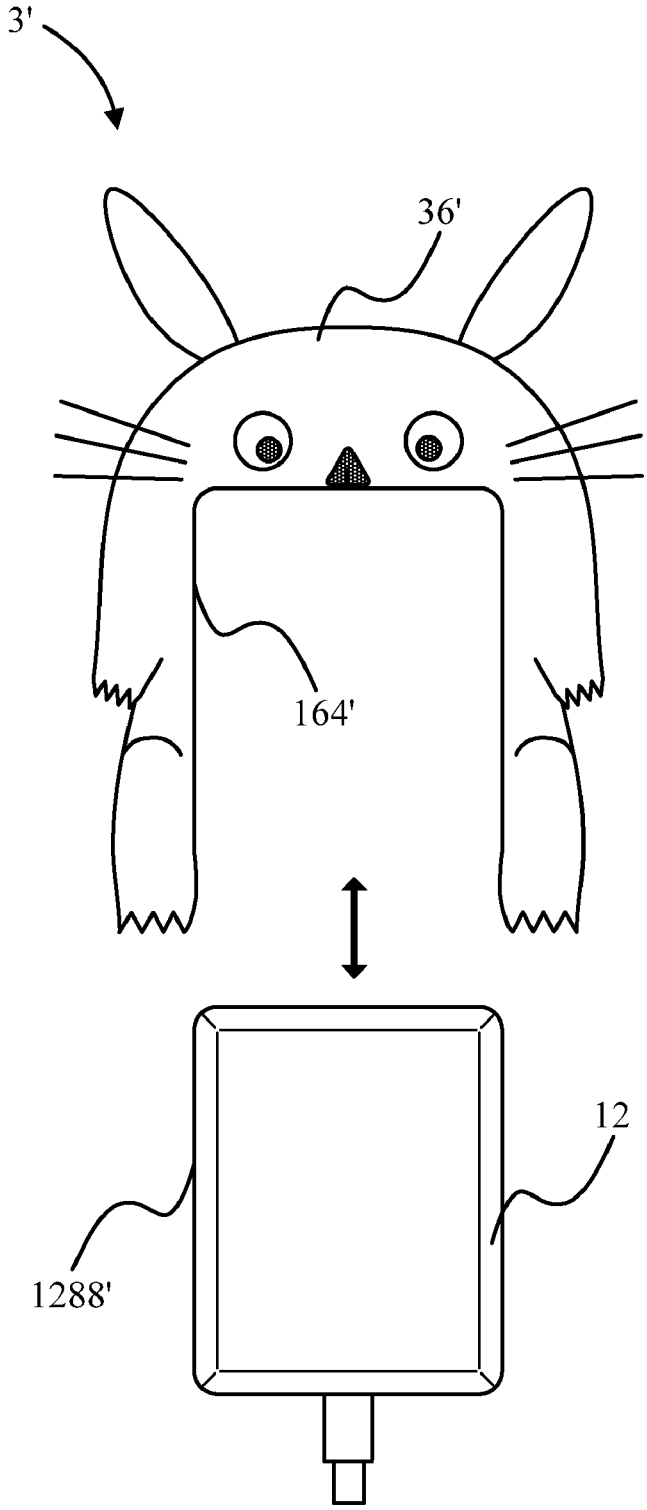
FIG. 3B is a breakdown diagram illustrating a light-emitting diode illuminating equipment according to an embodiment.

Please refer to FIG. 3B. FIG. 3B is a breakdown diagram illustrating a light-emitting diode illuminating equipment 3' according to an embodiment. Compared with the second preferred embodiment, the clipping portion 164' of the replaceable shell 36' of the light-emitting diode illuminating equipment 3' is the portion which the illuminating apparatus 12 contacts with, and the fixing portion 1288' of the hollow barrel 128 of the illuminating apparatus 12 is the portion which the clipping portion 164 contacts with, as shown in FIG. 3B. Thereby, the replaceable shell 36' could be faster to be assembled with the illuminating apparatus 12.

Figure 4:
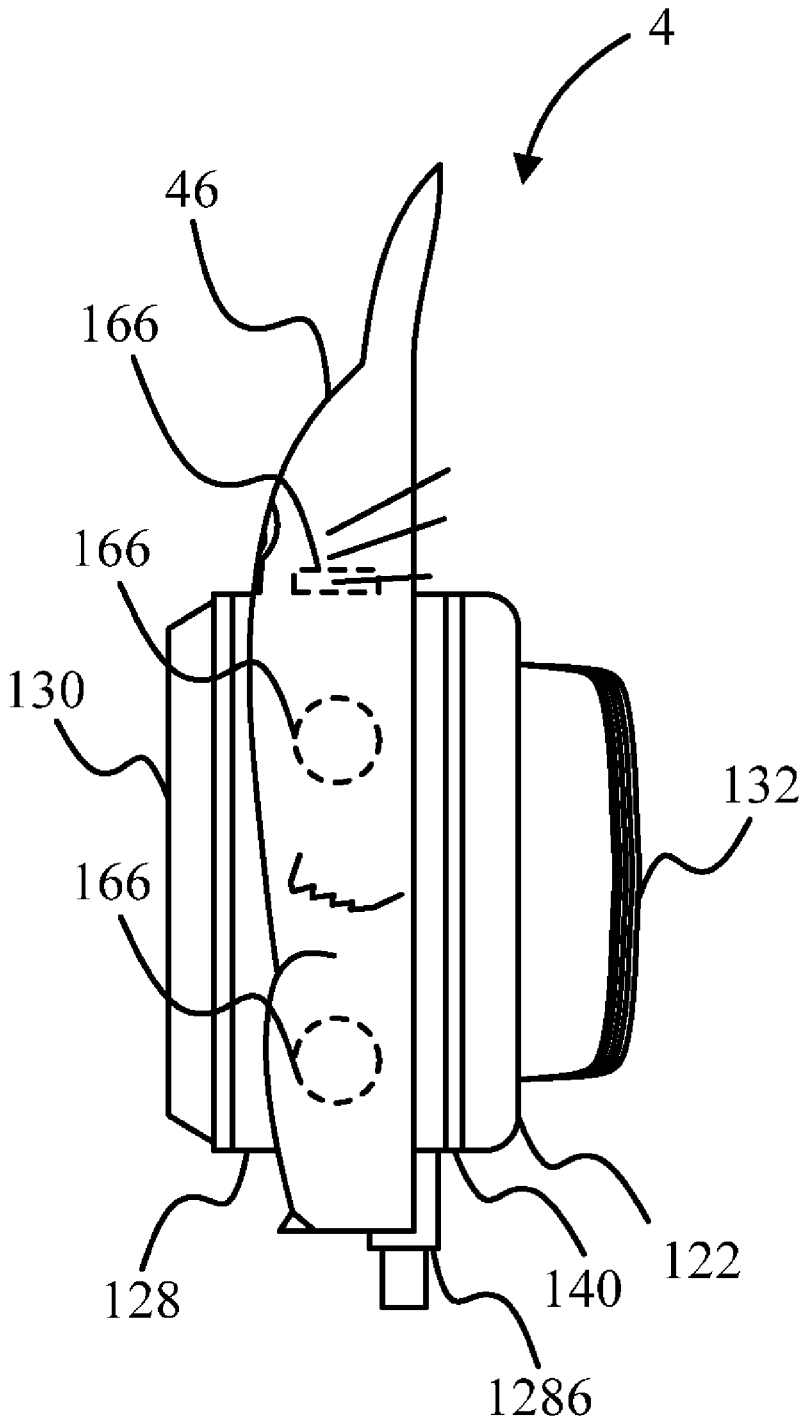
FIG. 4 is a side view of a light-emitting diode illuminating equipment according to a third preferred embodiment.

Please refer to FIG. 4. FIG. 4 is a side view of a light-emitting diode illuminating equipment 4 according to a third preferred embodiment. Compared with the first preferred embodiment, the hollow barrel 128 of the light-emitting diode illuminating equipment 4 is made of magnetic material, and the replaceable shell 46 includes several magnets 166. Thereby, the replaceable shell 46 is magnetized through the magnets 166 on the hollow barrel 128, as shown in FIG. 4. In an embodiment, the replaceable shell 46 could also be made of magnetic material, and the hollow barrel 128 includes at least one magnet. Thereby, the replaceable shell 46 could still be magnetized on the hollow barrel 128.

Figure 5:
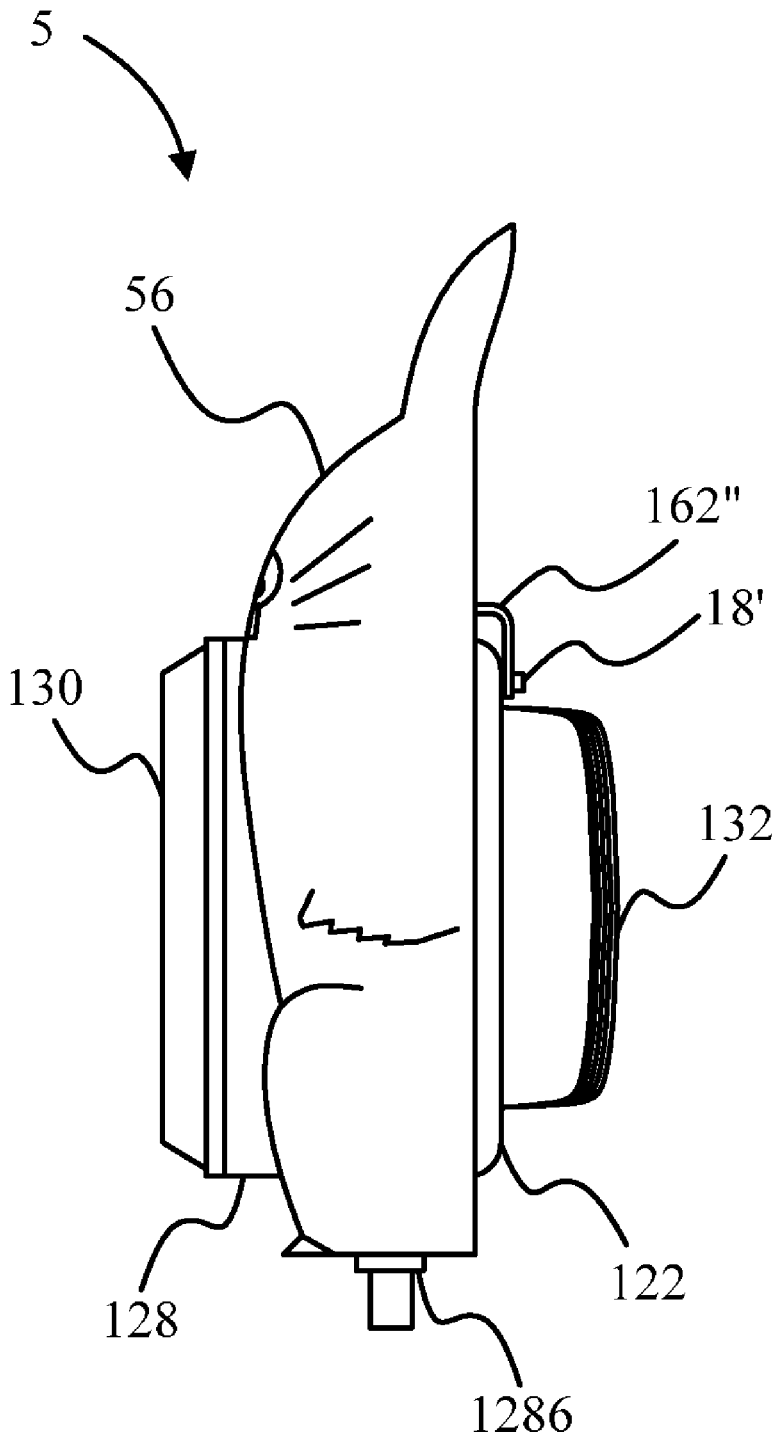
FIG. 5 is a side view of a light-emitting diode illuminating equipment according to a fourth preferred embodiment.

Please refer to FIG. 5. FIG. 5 is a side view of a light-emitting diode illuminating equipment 5 according to a fourth preferred embodiment. Compared with the first preferred embodiment, the replaceable shell 56 of the light-emitting diode illuminating equipment 5 is detachable to be engaged to the heat-dissipating plate device 122. The replaceable shell 56 includes a fixing piece 162". The replaceable shell 56 is engaged to the heat-dissipating plate device 122 by screwing a screw 18', as shown in FIG. 5. In an embodiment, the replaceable shell 56 is made of heat-conducting material. When the replaceable shell 56 contacts only the heat-dissipating plate device 122, the replaceable shell 56 made of heat-conducting material could be treated as a heat-dissipating fin for assisting in dissipating heat.

Figure 6:
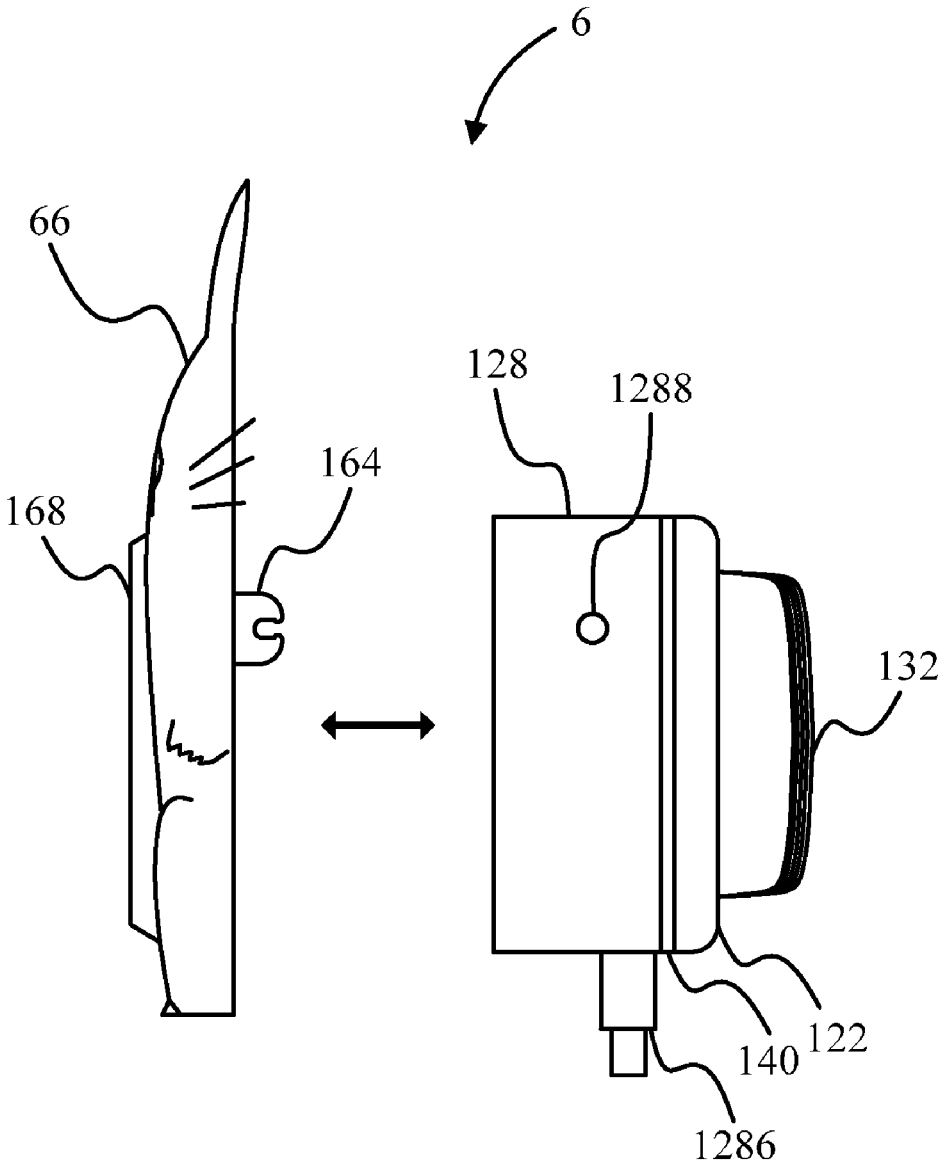
FIG. 6 is a breakdown diagram illustrating a light-emitting diode illuminating equipment according to an fifth preferred embodiment.

Please refer to FIG. 6. FIG. 6 is a breakdown diagram illustrating a light-emitting diode illuminating equipment 6 according to a fifth preferred embodiment. Compared with the first preferred embodiment, the difference is that the transparent shield 168 of the light-emitting diode illuminating equipment 6 is not necessary to be engaged to the hollow barrel 128, and the transparent shield 168 is part of the replaceable shell 66. That is, the replaceable shell 66 includes the transparent shield 168 covering the diode light-emitting devices 126, but they are not limited to be made in one piece. The engagement of the replaceable shell 66 and the illuminating apparatus 12 could be made based on the methods mentioned in the above embodiments. According to the fifth preferred embodiment, the replaceable shell 66 is engaged to the illuminating apparatus 12 by clipping the clipping portion 164 with the fixing portion 1288 of the hollow barrel 128.

Incidentally, the replaceable shells shown in the above embodiments are single side shell for clearly describing the features of the light-emitting diode illuminating equipment of the invention. However, the replaceable shell of the light-emitting diode illuminating equipment of the invention is not limited to this. For example, the replaceable shell could be a multifaceted style shell covering the most illuminating apparatus to beautify the appearance of the light-emitting diode illuminating equipment.

As described above, the light-emitting diode illuminating equipment includes a replaceable shell and still retains a good heat-dissipating structure. Furthermore, the replaceable shell could be attached only to the hollow barrel, the heat-dissipating fins, or other place to attach. The replaceable shell could be easily and fast attached and detached without influence on the original heat-dissipating structure. Therefore, the replaceable shell of the light-emitting diode illuminating equipment could be replaced with different shells to beautify the light-emitting diode illuminating equipment, which is both practical and beautiful.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting diode illuminating equipment, comprising:

an illuminating apparatus comprising:

a heat-dissipating plate device comprising a first surface;

M first heat-conducting devices, each of the first heat-conducting devices comprising a first portion and a second portion, the second portion extending from the first portion and comprising a flat area end, the first portion being mounted on the first surface of the heat-dissipating plate device, M being a natural number;

N diode light-emitting devices, each of the diode light-emitting devices being disposed on the flat area end of one of the first heat-conducting devices and converting an electric energy into a light, N being a natural number, N being larger or equal to M; and a hollow barrel comprising a circumference, the hollow barrel being engaged through the circumference to the heat-dissipating plate device to form a space for accommodating the first heat-conducting devices and the diode light-emitting devices; and a replaceable shell detachable to be engaged to the hollow barrel.

2. The light-emitting diode illuminating equipment of claim 1, wherein the illuminating apparatus comprises a transparent shield engaged to the hollow barrel.

3. The light-emitting diode illuminating equipment of claim 1, wherein the replaceable shell is made of heat-conducting material.

4. The light-emitting diode illuminating equipment of claim 1, wherein the replaceable shell comprises a transparent shield for covering the diode light-emitting devices.

5. The light-emitting diode illuminating equipment of claim 1, wherein the hollow barrel comprises a first fixing column, and the replaceable shell is detachable to be engaged to the first fixing column.

6. The light-emitting diode illuminating equipment of claim 5, wherein the hollow barrel comprises a second fixing column, and the illuminating apparatus is detachable to be engaged through the second fixing column to a support.

7. The light-emitting diode illuminating equipment of claim 1, wherein the replaceable shell comprises a clamping portion, the hollow barrel comprises a fixed portion, and the clamping portion is detachable to be engaged to the fixed portion.

8. The light-emitting diode illuminating equipment of claim 1, wherein the hollow barrel is made of magnetic material, the replaceable shell comprises a magnet, and the replaceable shell is magnetized through the magnet on the hollow barrel.

9. The light-emitting diode illuminating equipment of claim 1, wherein the illuminating apparatus comprises a partition plate device disposed in the hollow barrel to divide the space into a first room and a second room, the partition plate device comprises P first holes, each of the diode light-emitting devices corresponds to one of the first holes, P is a natural number, and P is smaller or equal to N.

10. The light-emitting diode illuminating equipment of claim 9, wherein the partition plate device is capable of insulating heat.

11. The light-emitting diode illuminating equipment of claim 9, wherein the illuminating apparatus comprises a heat-insulating plate device disposed in the first room, the heat-insulating plate device comprises M second holes, and the second portion of each of the first heat-conducting devices corresponds to one of the second holes and passes through the corresponding second hole.

12. The light-emitting diode illuminating equipment of claim 1, wherein the heat-dissipating plate device comprises M first grooves formed on the first surface of the heat-dissipating plate device, and the first portion of each of the first heat-conducting devices is mounted on corresponding one of the first grooves.

13. The light-emitting diode illuminating equipment of claim 12, wherein a heat-conducting material is filled between the first portion of each of the first heat-conducting devices and the corresponding first groove.

14. The light-emitting diode illuminating equipment of claim 1, wherein the illuminating apparatus comprises a plurality of second heat-conducting devices mounted on the first surface of the heat-dissipating plate device.

15. The light-emitting diode illuminating equipment of claim 14, wherein the heat-dissipating plate device comprises a plurality of second grooves formed on the first surface of the heat-dissipating plate device, and each of the second heat-conducting devices is mounted on corresponding one of the second grooves.

16. The light-emitting diode illuminating equipment of claim 15, wherein a heat-conducting material is filled between each of the second heat-conducting devices and the corresponding second groove.

17. The light-emitting diode illuminating equipment of claim 1, wherein the illuminating apparatus comprises a plurality of heat-dissipating fins, the heat-dissipating plate device comprises a second surface opposite to the first surface, and the heat-dissipating fins extend from the second surface and are exposed to air.

18. The light-emitting diode illuminating equipment of claim 17, wherein the illuminating apparatus comprises a plurality of second heat-conducting devices mounted on the second surface of the heat-dissipating plate device.

19. The light-emitting diode illuminating equipment of claim 1, wherein the illuminating apparatus comprises a heat-insulating ring, and the hollow barrel is engaged through the heat-insulating ring to the heat-dissipating plate device.

20. The light-emitting diode illuminating equipment of claim 1, wherein the flat area of the second portion of each of the first heat-conducting devices is at an end of the first heat-conducting device.

21. A light-emitting diode illuminating equipment, comprising:

an illuminating apparatus comprising:

a heat-dissipating plate device comprising a first surface;

M first heat-conducting devices, each of the first heat-conducting devices comprising a first portion and a second portion, the second portion extending from the first portion and comprising a flat area end, the first portion being mounted on the first surface of the heat-dissipating plate device, M being a natural number;

N diode light-emitting devices, each of the diode light-emitting devices being disposed on the flat area end of one of the first heat-conducting devices and converting an electric energy into a light, N being a natural number, N being larger or equal to M; and a hollow barrel comprising a circumference, the hollow barrel being engaged through the circumference to the heat-dissipating plate device to form a space for accommodating the first heat-conducting devices and the diode light-emitting devices; and a replaceable shell detachable to be engaged to the heat-dissipating plate device.

* * * * *